United States Patent [19]

Uchida

[11] Patent Number: 4,745,423

[45] Date of Patent: May 17, 1988

[54] PHOTOSENSITIVE MATERIAL PROCESSING APPARATUS

[75] Inventor: Shunji Uchida, Hachioji, Japan

[73] Assignee: Konishiroku Photo Industry Co., Ltd., Tokyo, Japan

[21] Appl. No.: 925,230

[22] Filed: Oct. 31, 1986

[30] Foreign Application Priority Data

Nov. 5, 1985 [JP] Japan ..... 60-248595

[51] Int. Cl.[4] ..... G03D 3/08

[52] U.S. Cl. ..... 354/320; 354/322; 226/188; 226/189; 355/28

[58] Field of Search ..... 354/316, 319, 320, 321, 354/322; 226/181, 188, 189, 190; 355/27, 28

[56] References Cited

U.S. PATENT DOCUMENTS

| | | | |
|---|---|---|---|
| 3,435,749 | 4/1969 | Cauwe et al. | 226/189 |
| 3,760,705 | 9/1973 | Miller | 354/322 |
| 4,291,969 | 9/1981 | Raymond | 354/322 |
| 4,327,989 | 5/1982 | Hope et al. | 354/322 |

FOREIGN PATENT DOCUMENTS

| | | | |
|---|---|---|---|
| 3242810 | 5/1984 | Fed. Rep. of Germany | 354/319 |

*Primary Examiner*—A. A. Mathews

*Attorney, Agent, or Firm*—Jordan B. Bierman

[57] ABSTRACT

Present invention provides a photosensitive material processing apparatus having an outside unit, an inside unit and a photosensitive material transport unit, in which both the outside unit and the inside unit are so shaped as to be a complementary figure with each other and the inside unit can position in the outside unit. The photosensitive material transport unit having a plurality of rollers for transporting the photosensitive material in a sandwiching manner therebetween. The plurality of rollers are divided into two groups of which the first group is provided to the outside unit and the second group is provided to the inside unit. The inside unit can be pulled out with the second group rollers from the outside unit.

5 Claims, 7 Drawing Sheets

PHOTOSENSITIVE MATERIAL PROCESSING APPARATUS

BACKGROUND OF THE INVENTION

This invention relates to a photosensitive material processing apparatus for developing such a silver halide photographic light-sensitive material as a photographic film, a photographic print paper and the like.

In general, a photosensitive material processing apparatus is used for processing an exposed photographic light-sensitive material and then drying it. In particular, the miniaturization in size of a processing apparatus, stabilization in processing, easiness in operation and readiness in cleaning and maintenance services are demanded for such an apparatus, especially when processing such a sheet-formed photographic light-sensitive material as a color print paper, an X-ray film for direct radiographic use, a printing film and the like.

An automatic processing apparatus for processing such a silver halide light-sensitive material as a photographic film, print paper and the like is normally provided, inside the frame body thereof, with a series of processing tanks respectively for developing, fixing, washing or the like use (the contents, arrangement order, number of tanks and the like may be varied) and a drying chamber. In this type of apparatus, such photosensitive materials are transported one after another through each of the processing tanks by means of such a transporting means as transport rollers and the like so as to be treated with each of the corresponding processing liquids and then transported into the drying chamber so as to be dried up with the hot air, and delivered out of the apparatus.

FIG. 7 illustrates an example of the copying machines equipped with such a photosensitive material processing apparatus as mentioned above, which is comprised of an image exposure section 10 provided to the uppermost position of the machine, a paper feed section 20 to the upper right position, a photosensitive material transport section 30 to the middle position, a processing section (i.e., a photosensitive material processing apparatus) 40 to the lower position and a drying section 50 to the right-hand side of the processing section 40.

The image exposure section 10 comprises an original document platen glass plate 11, light source 12, 1st scanning mirror 13, 2nd scanning mirror 14, 3rd scanning mirror 15, lens 16, 4th fixed mirror 17 and 5th fixed mirror 18. A bar-shaped halogen lamp is used as the light source, which gives a uniform exposure without any uneven light distribution in the direction of the axis thereof.

The 1st scanning unit comprising the light source 12 and the 1st scanning mirror 13 travels in parallel with the original document platen glass 11 so as to irradiate the original document. The exposure width at this time is from 10 to 15 mm on the original document platen glass plate. The 2nd scanning unit comprising the 2nd scanning mirror 14 and the 3rd scanning mirror 15 is mounted to a traveling board so as to travel in the same travelling direction of the 1st scanning unit at one-half of the travelling speed of the 1st scanning unit. Both of the 1st and 2nd scanning units are synchronized to operate with a speed of a photosensitive material being transported by the transport section 30. The above-mentioned exposure scanning method is almost similar to those having been applied to the well-known types of electrophotographic copying machines and the like. In this exposure scanning method, however, an image is reversed by the final 5th mirror 18, so that a latent image corresponding to the original image is registered directly to the photosensitive surface of the photosensitive material used.

On the other hand, such a photosensitive material as a silver halide photographic material is prepared in the form of a roll and is then stored in a cassette 21 which is detachably placed to a prescribed position in the paper feed section 20 of the copying unit. The rolled photosensitive material R stored in the cassette 21 is then fed into transport section 30 through an inlet 22.

The rolled photosensitive material R fed into the transport section 30 is cut into sheets by a cutting device 33 when a prescribed length of the photosensitive material R is transported sandwichwise by the rotation of two pairs of transport rollers 31, 32. The resulting sheet-formed photosensitive material S is transported again by the transport roller 32 and supported on a sandwich manner between the upper and lower conveyor belts 34 being pressing with each other and is then shifted its course at nearly right angles to the original transport direction, so that it reaches the intermediate position 37, (i.e., an image forming position), between transport rollers 35, 36.

When the leading edge of the sheet-formed photosensitive material S passes through the image forming position 37, the aforementioned 1st scanning unit correspondingly scans an original document in a prescribed width while exposing the original to light on the original document platen glass plate 11 and the 2nd scanning unit synchronously travels with the 1st scanning unit. This scanning and exposing luminous flux from the above-mentioned units forms a latent image on the photosensitive surface of the sheet-formed photosensitive material S in the image forming position 37 after the flux passes through a lens 16 and by way of the 4th mirror 17 and the 5th mirror 18.

The sheet-formed photosensitive material S already scanned and exposed is sent into an accumulator section 38 and passes through a developing tank 41, a bleach-fixing tank 42, the 1st stabilizing tank 43 and the 2nd stabilizing tank 44 each in the processing section 40 and is then dried up with hot air in the drying section 50, so that the completely processed sheet-formed photosensitive material S is delivered out from an exit to the outside of the machine.

The above-mentioned processing section 40 is provided to the bottom of the image exposure section 10 and the photosensitive material transport section 30 and is arranged laterally with the above-mentioned tanks 41, 42, 43, 44, which are filled up with a developer CD, a bleach-fixer BF, a washing liquid or a stabilizer SR, respectively. The developer CD for developing a silver halide photographic material and, interalia, a color photosensitive material is of the highly alkaline. Therefore, an alkaline resistive material is used for each of the members of developing tank 41.

Each of the processing tanks is provided therin with a rack member which is comprised of a gear train comprising a plurality of gear members for transmitting a rotary driving force from a driving source, a plurality of roller trains and guide plates being rotated by the gear train so as to transport a sheet-formed photosensitive material S and a frame member for supporting the gear train, roller trains, guide plates and the like.

Each of the rack members is so made as to be freely detachable from its own processing tank. The rack member may be pulled out of the processing tank so as to clean up the processing tank or the rack member, to check up and remedy it, or to remedy a clogging (a jamming) of a sheet-formed photo-sensitive materials in the tank, and the rack member may be restored to the original position by inserting it again into the processing tank, when the above-mentioned services are completed.

In such a conventional type of photosensitive material processing apparatuses as mentioned above, the rack members have been detached from the apparatuses.

It has, therefore, been inconvenient to attend on a clogged material or to perform such a maintenance service as a cleaning of a tank. Particularly in an apparatus for processing sheet-formed photosensitive materials, it has been inconvenient, when a clogging has occurred, to take out the clogged material so as to restore the apparatus in operable conditions.

SUMMARY OF THE INVENTION

It is, accordingly, an object of the invention to provide a photosensitive material processing apparatus capable of removing such a defect of the conventional art as mentioned above and of being convenient for performing the maintenance thereof.

The photosensitive material processing apparatuses of the invention capable of achieving the above-mentioned objects are characterized in that the photosensitive material transport unit comprises a plurality of rollers for transporting a photosensitive material with sandwiching the material, the plurality of rollers are divided into an outside subunit having one part of the rollers and an inside subunit having the other part of the rollers and the above-mentioned inside subunit is so made as to be pulled out of the outside subunit. As for a preferable embodiment, it is characterized in that either one part of the rollers is connected to a driving source and the other part thereof is driven by the one part of the rollers and, further, the subunit connected to the driving source is also so made as to be pulled out.

DETAILED DESCRIPTION OF THE INVENTION

Now, the invention will be described in detail, with reference to the examples shown in the accompanying drawings. It is, however, to be understood that the invention shall not be limited to the embodiments of the examples described herein.

Figure 1:
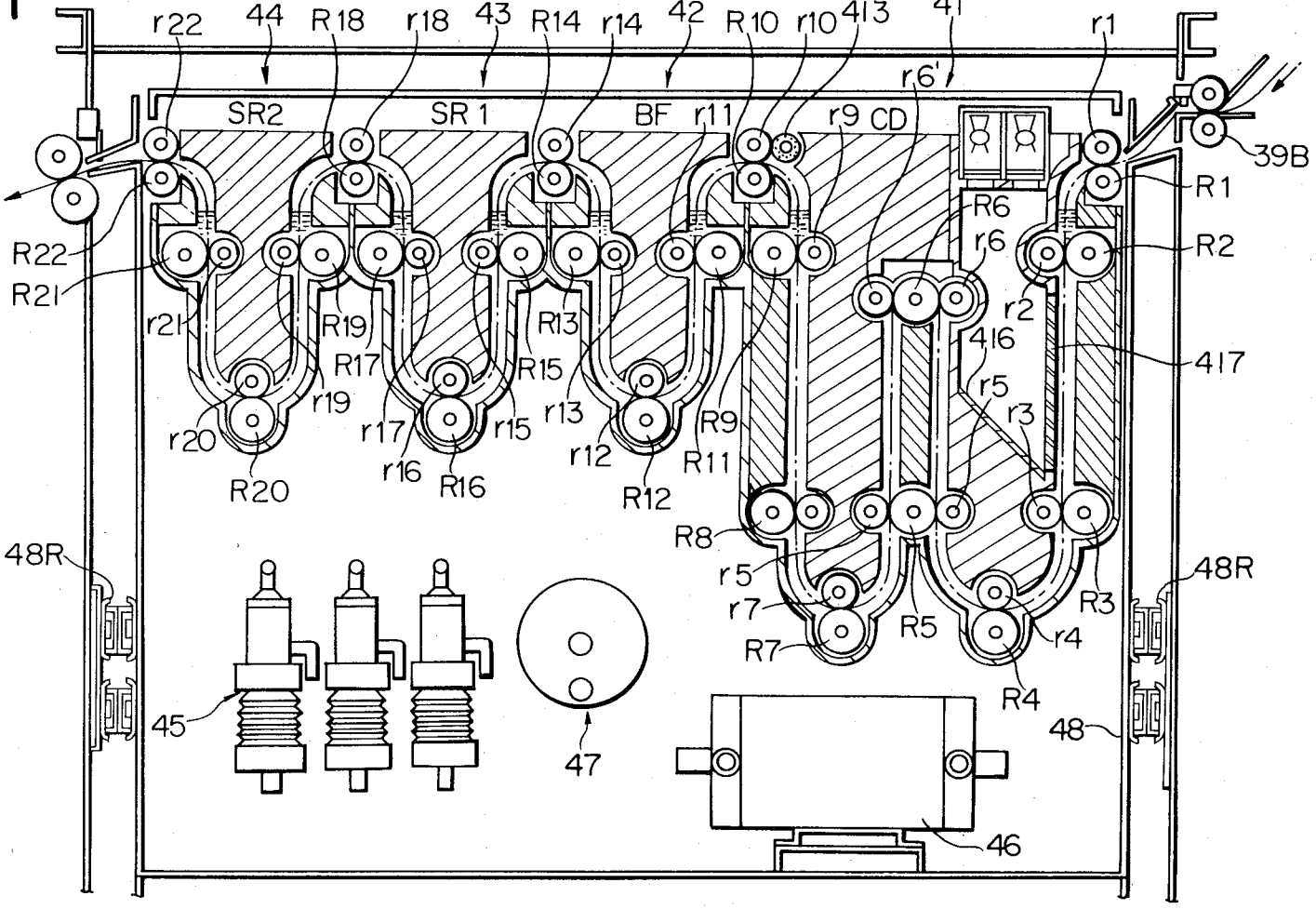
FIG. 1 illustrates a sectional view of a photosensitive material processing apparatus of the invention.
Figure 2:
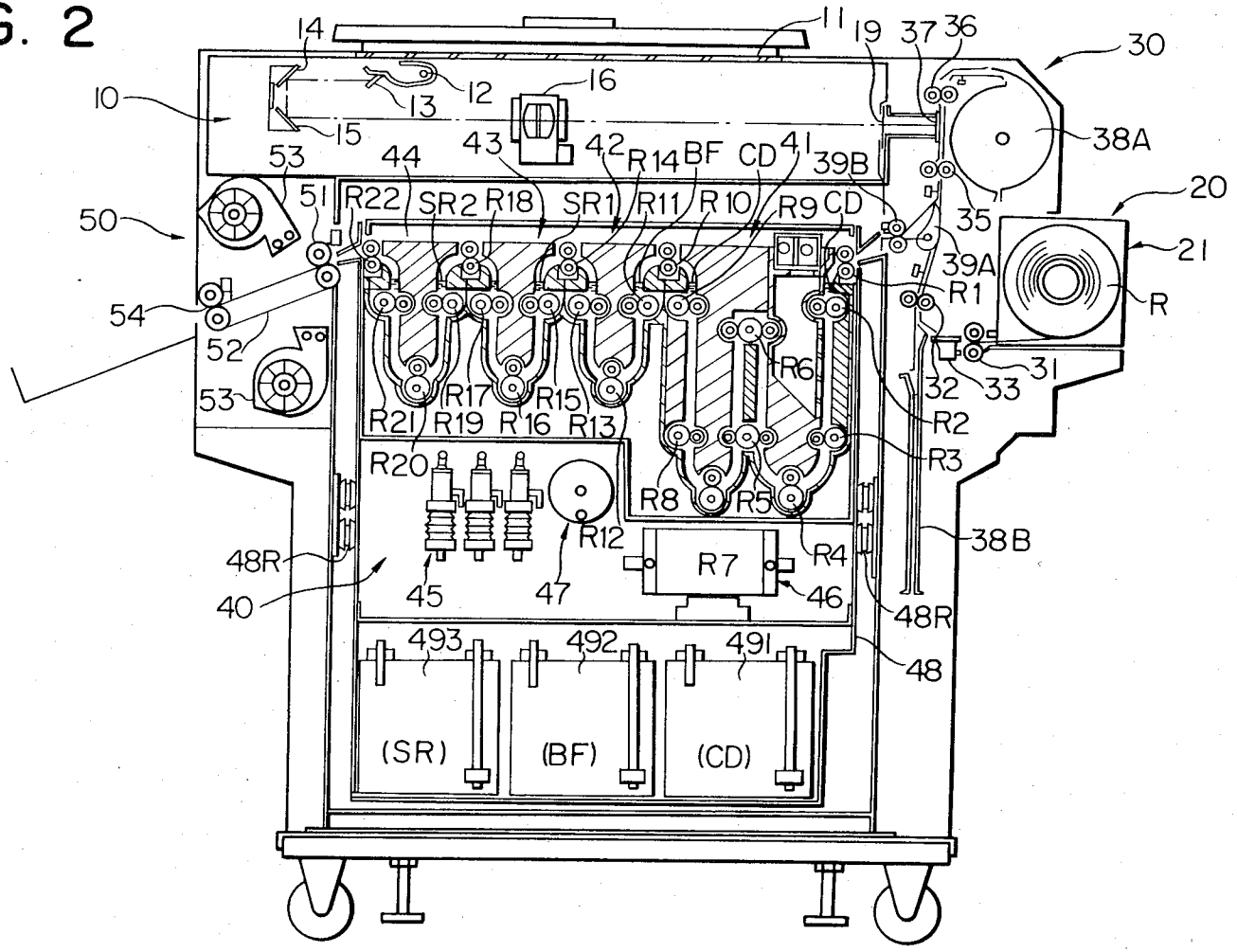
FIG. 2 illustrates a sectional view of a copying machine provided with the above-mentioned photosensitive material processing apparatus.
Figure 3:
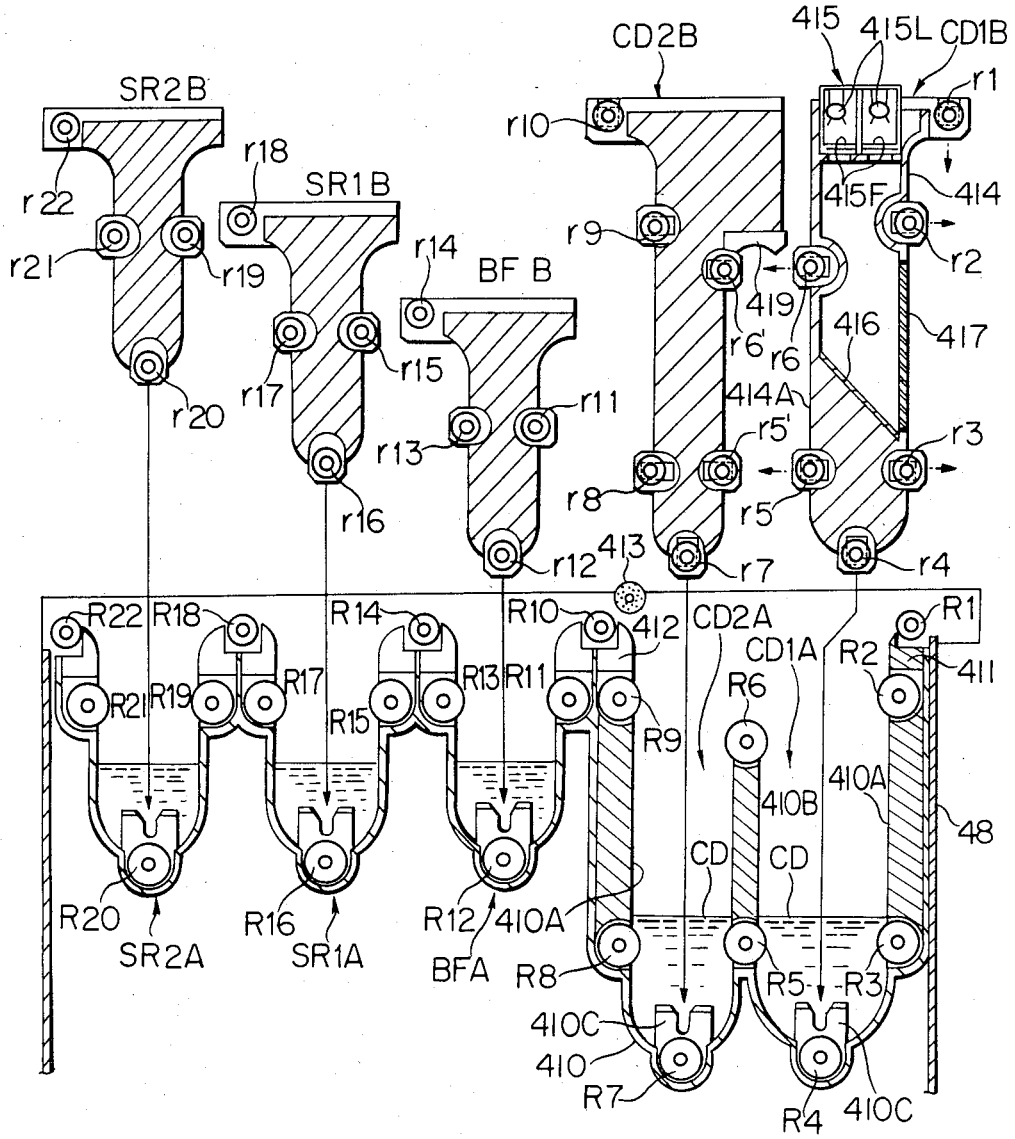
FIG. 3 is a sectional view of the photosensitive material processing apparatus showing a state that the inside subunit and outside subunit thereof are seperated from each other.
Figure 4:
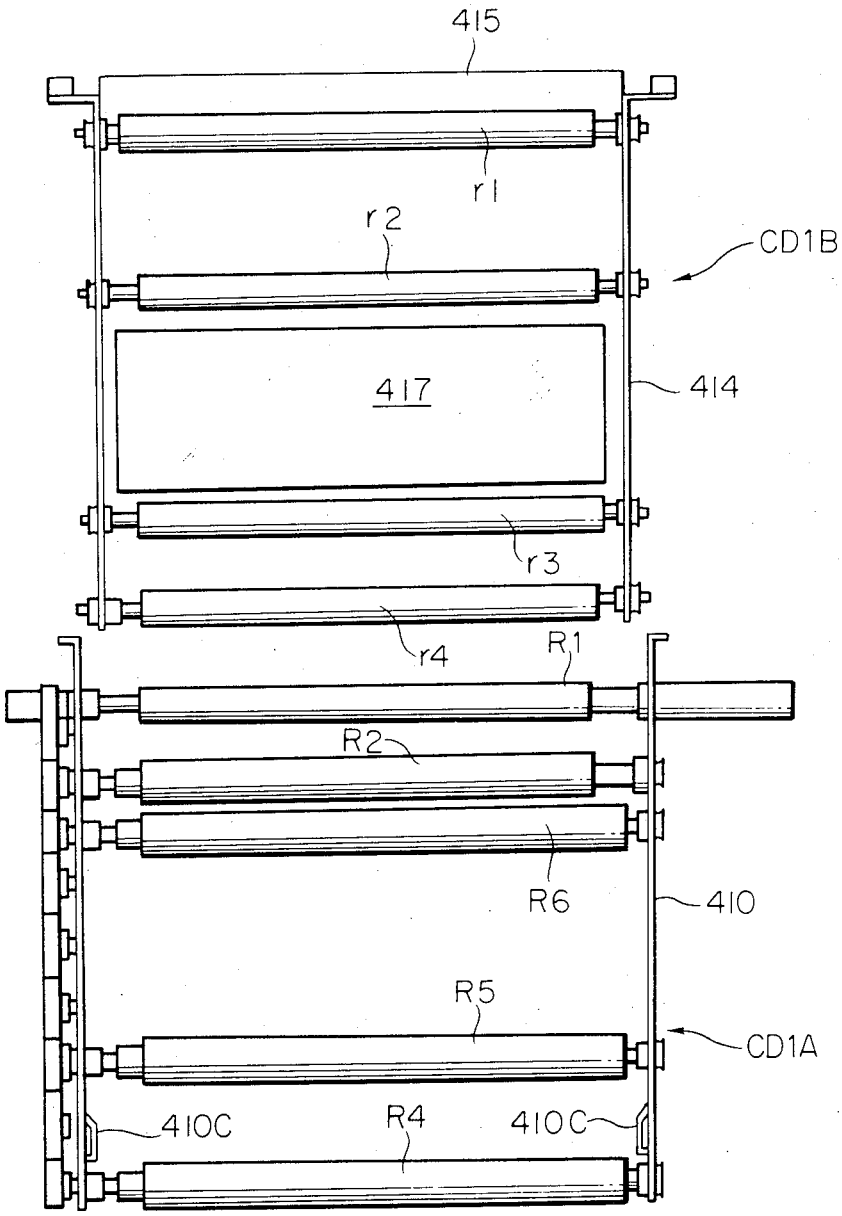
FIG. 4 is a side view of FIG. 3.
Figure 7:
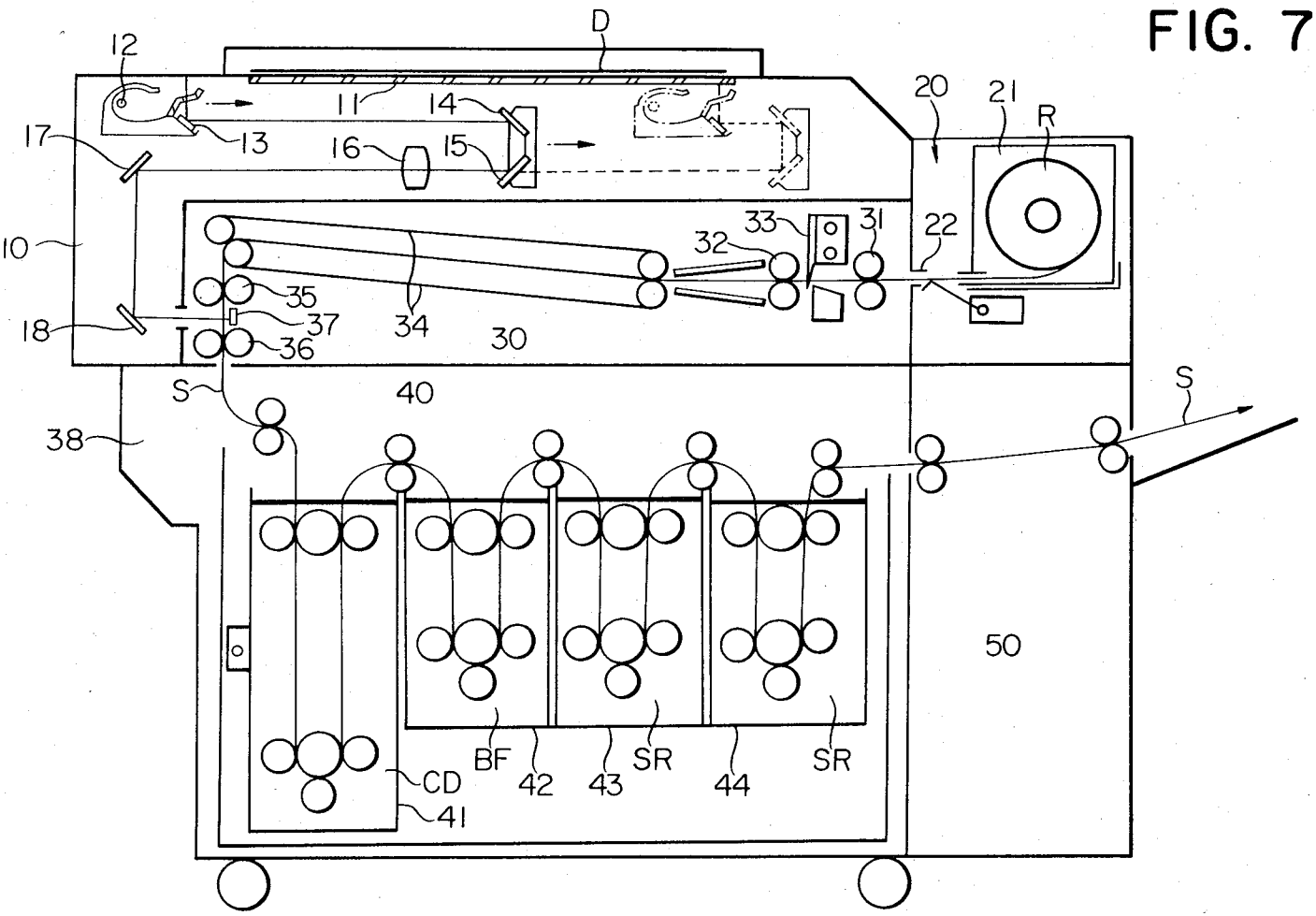
FIG. 7 is a structural illustration of a copying machine equipped with a conventional type of processing apparatus.

FIG. 1 illustrates a sectional view of a photosensitive material processing apparatus of the invention; FIG. 2 illustrates a sectional view of a copying machine provided with the above-mentioned photosensitive material processing apparatus; FIG. 3 is a sectional view of the photosensitive material processing apparatus showing a state that an inside subunit thereof is pulled up from an outside subunit thereof; and FIG. 4 is a side view of FIG. 3. In the drawings above, the same functional members as those shown in FIG. 7 are given like reference characters.

As shown in the structural illustration given in FIG. 2, a copying machine relating to the invention comprises an image exposure section 10 in the uppermost position, a paper feed section 20 and a photosensitive material transport section 30 each in the right-hand side, a freely movable image processing section 40 arranged below the above-mentioned image exposure section 10 and a drying section 50 arranged to the left-hand side of the image exposure section 40, respectively.

The above-mentioned image exposure section 10 comprises an original document platen glass plate 11, a light source 12, the 1st mirror 13, the 2nd mirror 14, the 3rd mirror 15, a lens 16 and a shutter 17. The 1st scanning unit comprising the light source 12 and the 1st mirror 13 travels in parallel with the original document platen glass plate 11 to scan an original document while exposing it to light. The 2nd scanning unit comprising the 2nd mirror 14 and the 3rd mirror 15 is mounted to a travelling board to travel in the same direction of the 1st scanning unit at a speed one-half as fast as that of the 1st scanning unit. Both of the above-mentioned 1st and 2nd scanning units are synchronized in operation with a speed of a photosensitive material being transported by the photosensitive material transport section 30. The above-mentioned exposure scanning is almost similar to those being used in the well-known electrophotographic copying machines and the like. In this exposure scanning system, an image is reversed by making use of odd numbers of mirrors and the latent image corresponding to an original document image is formed directly on the photosensitive surface of a photosensitive material. A shutter 19 is always closed, except that the shutter is opened synchronously with the above-mentioned operation of exposure scanning at the time when the latent image is formed, so that no fog may be produced on the photosensitive material by light from the outside.

The photosensitive materials which are to be used in the invention shall be those for forming positive images thereon through exposures and processing treatments and a silver halide photographic light-sensitive material is used in order to obtain high quality copied images and color-copied images in particular. The silver halide photographic light-sensitive materials suitable for the above-mentioned purposes include, for example, an internal latent image type or other direct reversal type silver halide photographic light-sensitive material, a reversal type (i.e., a reversal development type) silver halide photographic light-sensitive material and the like. The supports (i.e., the bases) of the above-mentioned silver halide photographic light-sensitive materials are allowed to be either of an opaque paper and the like or of a transparent film and the like. The above-mentioned silver halide photographic light-sensitive materials are also allowed to be either in color or in black-and-white. In addition to the above, the invention can further be applied not only to the silver halide photographic light-sensitive materials but also to the other light-sensitive materials.

The above-mentioned silver halide photographic light-sensitive materials are formed each in roll and packed in a cassette 21 in a light-proof condition. The cassette 21 is detachably placed to a prescribed position of paper feed section 20 of a copying machine. The leading edge of a roll-formed silver halide photographic light-sensitive material (hereinafter called a roll-formed photosensitive material) R is fed from the cassette 21 into the transport section 30.

Next, the transporting state where how is a sheet-formed photosensitive material being transported in transport section 30 will be described in the following items (1) through (5):

(1) A roll-formed photosensitive material R fed into transport section 30 is sandwiched with pressure between transport rollers 31, 32, 35 and 36 so as to be conveyed upward and, when a prescribed length (such as a length of the short sides in A-4 size, the long sides in B-4 and A-3 sizes, and the like) of R is conveyed, the photosensitive material R is cut into the sheet form by a cutting device 33.

(2) The resulting cut-sheet-formed silver halide photographic light-sensitive material (hereinafter called sheet-formed photosensitive material) S is conveyed by the above-mentioned transport rollers 32, 35 and 36 and is then rolled temporarily into the 1st accumulator 38A located above.

(3) Next, the above-mentioned sheet-formed photosensitive material S is conveyed downward by the transport rollers 36, 35 and 32 so as to be stored in the 2nd accumulator 38B. In the process of this transportation, that is, in the course that the sheet-formed photosensitive material S is passing through the image focussed position in the above-mentioned image exposure section 10, the above-mentioned 1st scanning unit correspondingly makes an exposure-scanning of an original document image in a prescribed width on the original document platen glass plate 11 and, at the same time, the 2nd scanning unit also travels synchronously. The exposure-scanning light flux produced thereby passes through lens 16 and forms the latent image of the original image in the focussed position 37 on the sheet-formed photosensitive material S.

(4) The already exposed and scanned sheet-formed photosensitive material S, which was stored in the aforementioned 2nd accumulator 38B, is conveyed upward again by the transport rollers 36, 35 and 32 and is then so rolled up once again as to be stored in the aforementioned 1st accumulator 38A.

(5) Successively, the sheet-formed photosensitive material S is started to go down by the reverse rotation of the transport rollers 36 and 35, and the transport direction of the photosensitive material S is changed by the clockwise rotation of a claw member 39A and is then fed into processing section 40 by transport roller 39B.

The processing section 40 comprises a series of tanks, namely, developing tank 41, bleach-fixing tank 42, 1st stabilizing tank 43, 2nd stabilizing tank 44, and replenishing pump 45, circulating pump 46 and a liquid temperature adjusting tank (not shown) each stored in a single frame member 48. And, developer (CD) replenishing tank 491, bleach-fixer (BF) replenishing tank 492 and stabilizer (SR) replenishing tank 493 are provided to the inside of the main body of a copying machine, that is, to the lower portion of the above-mentioned frame member 48, so as to be freely detachable from the machine body.

The above-mentioned developing tank 41 comprises an outside subunit for storing a developer (CD), which is fixed to the frame member 48, and two pieces of inside subunits which are detachably mounted to the outside unit, respectively.

Referring now FIG. 3 the outside subunit comprises two processing tanks CD1A and CD2A each containing developer (CD), and to which a processing tank wall member 410 for supporting each of the transport members, a series of driving transport rollers R1, R2, R3, R4, R5, R6, R7, R8, R9 and R10, a cleaning roller 413 and guide plates 411 and 412 each are arranged.

The inner wall of the processing tank wall member 410 is provided in a body with two sides of transport guide walls 410A for forming a passage for guiding a sheet-formed photosensitive material S, transport guide wall 410B erecting in the center of the processing tank to form a partition wall and two bearing members 410C protruded respectively from the front and back in the neighbourhood of the bottom of the tank.

The above-mentioned driving transport rollers R1 through R10 are driven to rotate by the gear train arranged to the side plates provided respectively to the both sides of the processing tank wall 410. The cleaning roller 413 is mounted to the upper part of the processing tank wall 410 in the neighbourhood of the transport roller R10.

On the other hand, out of the two sets of the inside subunits, the 1st inside subunit CD1B which is closer to the inlet for feeding in a sheet-formed photosensitive material S than the other inside subunit is arranged with a wall member 414, 6 pieces of driven rollers r1, r2, r3, r4, r5, r6 which are driven to rotate by coming into pressure contact with the above-mentioned driving transport rollers R1 through R6, a fog exposure light source 415 provided detachably to the upper part of the wall member 414, a reflector member 416 provided to the internal hollow portion of the wall member 414 at a level of about 45° and a transparent member 417 for shielding liquid-tightwise the right-hand side aperture of the hollow portion of the wall member 414.

The both shaft ends of each of the above-mentioned driven rollers r1 through r6 are square-formed in a certain length from the tips and are inserted in the longitudinal grooves each of the wall member 141 so as to be movable back and forth linearly (from 1 to 5 mm). The both ends of every shaft of driven rollers r1 through r6 are biased in the directions of the arrow marks by spring members such as coil springs. The both shaft ends of the driven roller r4 are protruded to the outside and, when the inside subunit CD1B is loaded in the processing tank CD1A of the outside subunit, the both shaft ends are inserted into and engaged with the aforementioned bearing section 410C, so that the inside subunit CD1B may correctly be positioned.

The fog exposure light source 415 is provided thereinside with two pieces of cold cathode ray tube 415L and two kinds of color filters 415F. Namely, if either one of the cold cathode ray tubes is lit according to the kind of a photosensitive material selected for making a copied image, the illuminating light transmits through the color filters 415F so as to compensate the color and irradiates the hollow portion inside the wall member 414 and the light is then reflected by the reflector member 416. The reflected light transmits through the transparent member 417 and then makes an exposure (i.e., a fog-exposure) on a photosensitive material S being transported in a transport passage.

The outside subunit CD2A and inside subunit CD2B of the 2nd developing tank are similarly made detachable and they are correctly positioned when they are loaded. Further, the reference numeral 419 designates a guide plate provided to the neighbourhood of the driven roller 6' of the outside subunit CD2B in the 2nd developing tank so as to let a photosensitive material S take a U turn along the roller R6 when it is being transported along the roller r6 in the 1st developing tank and then to be fed along the roller r6' into the 2nd developing tank.

The cleaning roller 413 is provided to the upper part of the 2nd developing tank and is brought into pressure contact with driven roller r10 when the inside subunit is loaded. Driving roller R10 and driven roller r10 are positioned upper than the liquid level of developer (CD). They get wet with the developer when a photosensitive material is transported, and the crystals of the developer may be deposited on the surfaces of the rollers with a long passage of time. The cleaning roller 413 is, therefore, provided so as to avoid the above-mentioned deposition. As for the materials of the cleaning roller 413, those elastic and resistive against any developers are to be selected. For example, a natural fiber roll, a foam urethane material formed in a roll and the like may be used for.

As described above, the outside subunit having the 1st and 2nd developing tanks, CD1A and CD2A is arranged with the driving rollers R1 through R10 to the prescribed positions, respectively, and a gear train for driving the above-mentioned rollers R1 through R10 is arranged to the outside of the outside subunit so that every driving of the rollers is made outside. The inside subunit having the driven rollers r1 through r10 which are driven to rotate by the above-mentioned driving rollers R1 through R10 are detachable from the outside subunit, and the above-mentioned driven rollers r1 through r10 are each energized by the spring members, therefore, the inside subunit can readily be attached and detached without fail.

The inside subunit and the outside subunit are so shaped as to be a complementary figure with each other to form a communication passage for transporting the photosensitive passage.

Namely, the internal wal surfaces 410A and 410B of the outside subunit are so provided closely to the wall surface 414A and the transparent member 417 of the inside subunit as to form a photosensitive material transport passage. The capacity of the transport passage is so made as to be a minimum of necessity, therefore, a very small quantity of developer (CD) may be enough to fill up the passage. Provided, accordingly, that a minimum necessary quantity of developer (CD) is put into a developing tank to develop a photosensitive material and a fresh developer replenisher is constantly replenished thereto according to a consumption of the developer, the prescribed development characteristics of the developer in the developing tank can always be maintained by replenishing a minimum quantity of the replenisher.

Incidentally, the figures of the inside subunit and the outside unit are allowed a figure capable of forming the communication passage and not be limitted to the complementary figure.

The both upper ends of the walls of the inside subunits CD1B and CD2B are made in the form of a lid expanded like an umbrella or U-shape so as to cover the upper part of the photosensitive material passage, when the inside subunits are loaded in the outside subunits CD1A and CD2A, respectively. In other words, the gaps are minimized, except the gap of the photosensitive material passage. Therefore, the surface area of developer CD is substantially less exposed to the air, so that the developer CD is remarkably less changed by an oxidation or evaporation with passage of time. Also, there is not any fear that dusts or foreign matters may invade from the outside.

Meanwhile, bleach-fixing tank 42, 1st stabilizing tank 43 and 2nd stabilizing tank 44 are also of the two-divisional structure type, similar to the above-mentioned developing tank 41. It is also allowed to form the wall member of the outside subunits of each processing tank in a body with the wall member 410 of the developing tank.

In the drawing, BFA and BFB designate the outside and inside subunits of the bleach-fixing tank 42, respectively, and they are each comprised of driving rollers R11 through R14, driven rollers r11 through r14 which are brought into pressure contact with the above-mentioned driving rollers so as to be driven to rotate and a guide plate between the two subunits.

Similar to the above, the 1st and 2nd stabilizing tanks 43 and 44 are also of the two-divisional structure comprising the outside subunits SR1A, SR2A and the inside subunits SR1B, SR2B.

Figure 5:
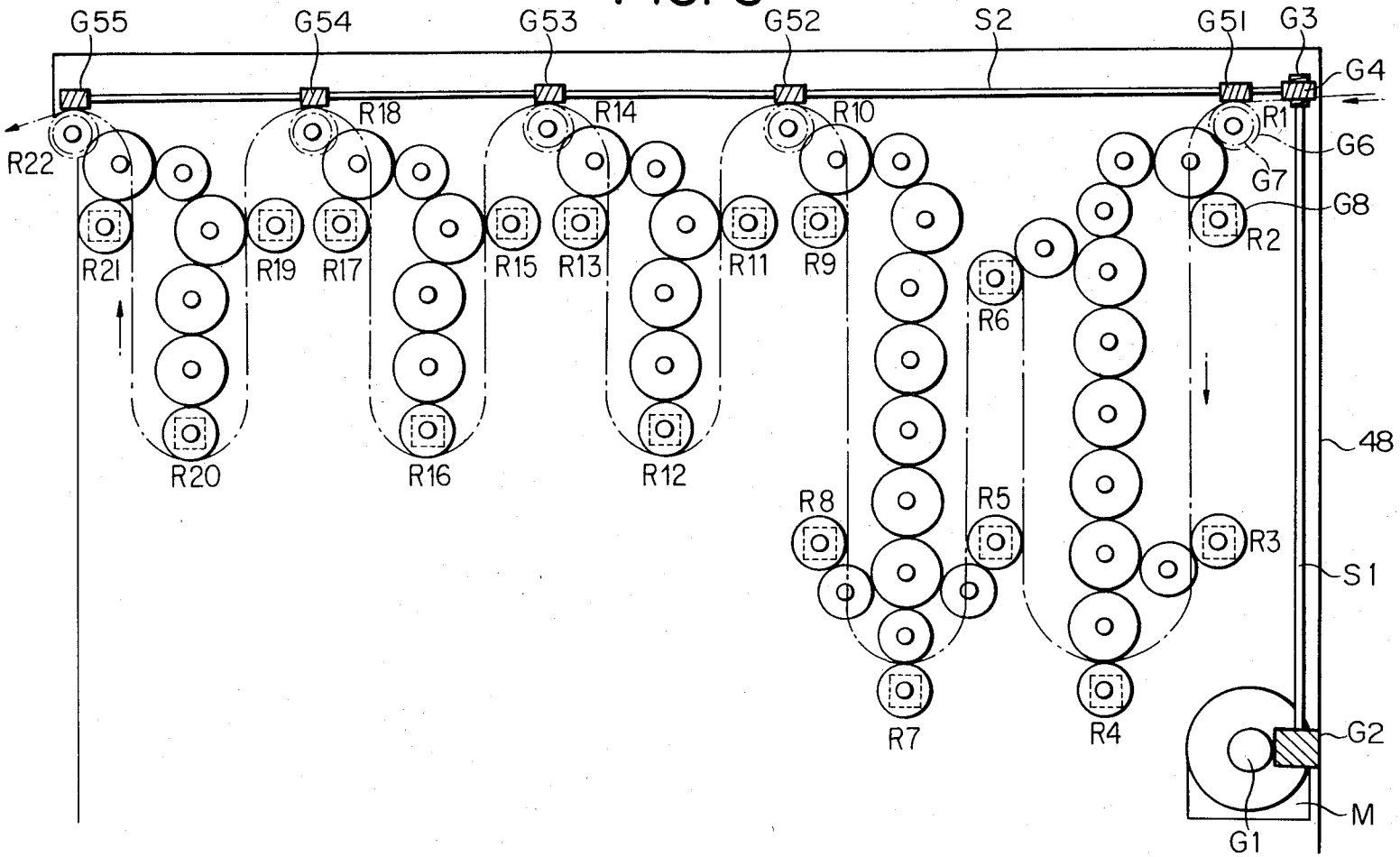
FIG. 5 is a diagram showing the driving system of the above-mentioned processing apparatus.

FIG. 5 is an illustration showing a gear train arranged to the side walls of the above-mentioned outside subunits. In this drawing, the alternate long and short dash lines designate transport passages for reference.

To the driving shaft of a transport driving motor (including, for example, an AC variable speed motor) M, a worm G1 is fixed so as to rotate a worm wheel G2 which is fixed to an intermediate shaft S1. To the other end of the intermediate shaft S1, a helical gear G3 is fixed so as to rotate helical gear G4 which is fixed to one end of the connecting shaft S2. Thereby, worms G51, G52, G53, G54 and G55 are rotated. The worm G51 rotates, through the gear train shown in the drawing, each of the shafts of the driving rollers R1, R2, R3, R4 and R6 of the 1st developing tank, respectively. The worm G52 rotates each of the shafts of driving rollers R10, R9, R8, R7 and R5 of the 2nd developing tank. The worm G53 rotates each of the shafts of driving rollers R14, R13, R12 and R11. The worm G54 rotates R18, R17, R16 and R15. The worm G55 rotates R22, R21, R20 and R19, respectively.

Figure 6:
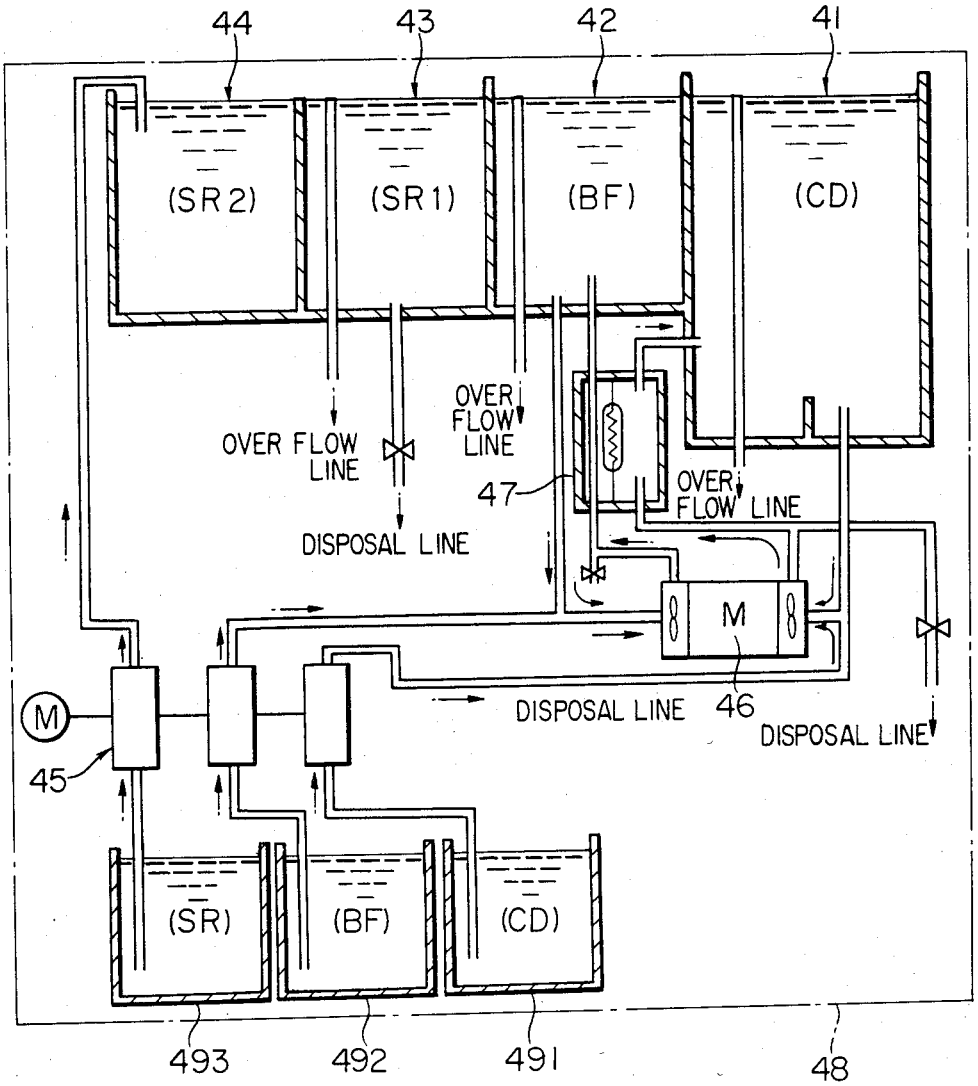
FIG. 6 is a diagram showing the circulating-replenishing system of the processing apparatus.

FIG. 6 is an illustration showing a replenishment circulation system of a processing liquid. A developer CD stored in a developer replenishing tank 491 and a bleach-fixer BF stored in a bleach-fixer replenishing tank 492 are replenished in a predetermined quantity, into a developing tank 41 and a bleach-fixing tank 42, respectively, through replenishment pipes, replenishing pumps 45, circulating pump 46 and liquid temperature regulating heater unit 47. The processing liquid CD and BF stored respectively in the developing tank 41 and the bleach-fixing tank 42 each are stirred and circulated by the above-mentioned circulating pump 46. Stabilizer SR stored in stabilizer replenishing tank 493 is fed into stabilizing tank 44 by the replenishing pump 45. Overflow pipes and waste liquid draining pipes as a disposed line are each provided to the upper and lower parts of the above-mentioned processing tanks 41, 42 and 43.

Each of the above-mentioned processing tanks, namely, the developing tank 41, bleach-fixing tank 42, 1st stabilizing tank 43 and 2nd stabilizing tank 44, such a driving system (as the motor, shafts, gear trains and the like shown in FIG. 5) for driving to rotate the driving rollers R1 through R22 of the processing tanks and such a circulating-replenishing system (as the pumps 45, 46, heater unit 47, piping and the like) for circulating-replenishing the every processing liquid are incorporated into a single frame member 48.

Between each of the above-mentioned frame member 48 and the main body frame of a copying machine, slide-rail members 48R are so fitted as to be able to pull the frame member 48 to the front of the copying machine body. When the frame member 48 is pulled, it becomes very easy to detach and attach the aforementioned inside subunit and to check up or remedy the outside subunit, driving system and circulating-replenishing system.

As described above, when the transport system, driving system and circulating-replenishing system are properly set up and driven in the processing section 40, a sheet-formed photosensitive material S is fed from the transport section 30 into the developing tank 41 so as to be developed and fog-exposed to light and, thereby, a visible image is produced on the photosensitive surface of the photosensitive material S and is then bleach-fixed in the successive bleach-fixing tank 42 and, further, it is stabilized with a washless stabilizer in the stabilizing tanks 43, 44. The sheet-formed photosensitive material S completely processed is transported into the drying section 50 by the transport roller 51 and transport wire 52 so as to be dried up the both sides thereof by a hot air type drier 53 and is then delivered outside of the machine through a delivery roller 54.

As described in detail above, a number of advantages can be enjoyed in the photosensitive material processing apparatuses of the invention, namely, each of the processing tanks is separated into an outside subunit and inside subunit and, at the same time, the inside subunit is so structured as to be small in size and easy to handle. Accordingly, the cleaning of the inside of the apparatus, removing of paper jamming, maintaining, checking up and remedying of the transport rollers and the like can very easily be performed. In these apparatuses also, the roller driving system and driving source are provided only to the outside subunit. Accordingly, the structure of the apparatuses can be simplified and substantially less troubles may arise and, further, the maintenance services thereof can easily be rendered. In addition to the above, the above-mentioned outside subunit is so made as to be drawable from the copying machine body. Accordingly, the driving system, circulating-replenishing system, transport system and the like can also readily be maintained. Still further, processing liquids are are used in a very small quantity in the transport passages and the processing liquid surfaces are so covered as to expose a small area thereof to the air. Accordingly, the processing liquids can be replenished in a small quantity and the oxidation and the like of the liquids can also be very small.

In a further embodiment of the invention, a cover member for shielding the surface of a processing liquid is provided to the inside subunit. In this embodiment, therefore, such a deterioration in a processing liquid as an oxidation and the like may be inhibited.

What is claimed is:

1. A photosensitive material processing apparatus comprising an outside unit disposed in a vessel, said outside unit having an opening at the top side thereof, and being capable of accommodating therein an inside unit, an inside unit adapted to be inserted into, and pulled out from said outside unit through the opening therein, wherein the inner periphery of said outside unit and the outer periphery of said inside unit form a communication passage therebetween for conveying the photosensitive material through the vessel when said inner unit is positioned within said outer unit, a plurality of roller pairs disposed along said communication passage, each of said roller pairs consisting of a driving roller and a driven roller, said driving roller being rotatably fixed onto the inner periphery of said outside unit and being capable of coupling with a driving source, said driven roller being fixed to the outer periphery of said inside unit by displacing means having a bias member, and being positioned in pressure contact with said driving roller when said inside unit is positioned within said outside unit, wherein said displacing means is capable of releasing the pressure contact between said driving rollers and said driven rollers so that said inner unit can be removed from said vessel without removing said outer unit.

2. The photosensitive material processing apparatus of claim 1 wherein said plurality of roller pairs are provided along said communication passage and said driven rollers are so contacted by the respective driving rollers as to transport said photosensitive material therebetween.

3. The photosensitive material processing apparatus of claim 1, wherein said communication passage can be filled with said processing solution.

4. The photosensitive material processing apparatus of claim 1, wherein said outside unit can be drawn out from said photosensitive material processing apparatus.

5. The photosensitive material processing apparatus of claim 4, wherein said inside unit comprises a covering member to cover said processing solution from outside while said inside unit is arranged in said outside unit.

* * * * *